US012256780B2

(12) United States Patent
Saygili

(10) Patent No.: US 12,256,780 B2
(45) Date of Patent: Mar. 25, 2025

(54) CARTRIDGE FOR AN AEROSOL-GENERATING SYSTEM, AN AEROSOL-GENERATING SYSTEM INCLUDING A CARTRIDGE, AND A METHOD OF MANUFACTURING A HEATER ASSEMBLY AND CARTRIDGE FOR AN AEROSOL-GENERATING SYSTEM

(71) Applicant: Philip Morris Products S.A., Neuchatel (CH)

(72) Inventor: Ali Murat Saygili, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 310 days.

(21) Appl. No.: 17/785,670

(22) PCT Filed: Dec. 17, 2020

(86) PCT No.: PCT/EP2020/086817
§ 371 (c)(1),
(2) Date: Jun. 15, 2022

(87) PCT Pub. No.: WO2021/123017
PCT Pub. Date: Jun. 24, 2021

(65) Prior Publication Data

US 2023/0346019 A1 Nov. 2, 2023

(30) Foreign Application Priority Data

Dec. 19, 2019 (EP) ..... 19218113

(51) Int. Cl.
*A24F 40/42* (2020.01)
*A24F 40/10* (2020.01)
*A24F 40/46* (2020.01)

(52) U.S. Cl.
CPC ..... *A24F 40/42* (2020.01); *A24F 40/10* (2020.01); *A24F 40/46* (2020.01)

(58) Field of Classification Search
CPC ..... A24F 40/10; A24F 40/42; A24F 40/46
See application file for complete search history.

(56) References Cited

U.S. PATENT DOCUMENTS 11,160,309 B2 * 11/2021 Mironov ..... H05B 6/108
2016/0338410 A1 * 11/2016 Batista ..... A24F 40/70
(Continued)

FOREIGN PATENT DOCUMENTS

EP 3 257 386 A1 12/2017
GB 2 548 647 A 9/2017
(Continued)

OTHER PUBLICATIONS

International Search Report issued Apr. 1, 2021 in PCT/EP2020/086817, filed on Dec. 17, 2020, 4 pages.
(Continued)

*Primary Examiner* — Truc T Nguyen
(74) *Attorney, Agent, or Firm* — Oblon, McClelland, Maier & Neustadt, L.L.P.

(57) ABSTRACT

A cartridge for an aerosol-generating device is provided, the cartridge including: a housing containing an aerosol-forming substrate, the housing including upper and lower housing portions; a heater element including a fluid-permeable heater portion and an electrical contact portion, in which the heater portion and the electrical contact portion are integrally formed from a single heater sheet, and in which the heater portion is enclosed within the housing and positioned to heat the substrate, and the electrical contact portion extends outside the housing; and an outer housing in which the upper and the lower housing portions are held, the outer housing including a sleeve into which the upper and the
(Continued)

lower housing portions are received such that the outer housing compresses the upper and the lower housing portions together to provide a seal therebetween. An aerosol-generating system, and a method of manufacturing a cartridge for an aerosol-generating device, are also provided.

16 Claims, 6 Drawing Sheets

(56) References Cited

U.S. PATENT DOCUMENTS

| | | | | |
|---|---|---|---|---|
| 2017/0164657 | A1 | 6/2017 | Batista | |
| 2017/0340012 | A1* | 11/2017 | Mironov | A24F 40/40 |
| 2018/0014575 | A1* | 1/2018 | Fursa | A61M 11/042 |
| 2018/0020737 | A1* | 1/2018 | Mironov | F16T 1/00 131/329 |
| 2018/0021997 | A1* | 1/2018 | Widmer | B29C 45/14336 29/611 |
| 2018/0027877 | A1 | 2/2018 | Tucker et al. | |
| 2019/0046745 | A1 | 2/2019 | Nettenstrom et al. | |
| 2019/0082739 | A1 | 3/2019 | Slivestrini et al. | |
| 2019/0098933 | A1* | 4/2019 | Courbat | H05B 3/06 |
| 2019/0230986 | A1* | 8/2019 | Zinovik | A24F 7/00 |
| 2019/0373955 | A1* | 12/2019 | Silvestrini | F22B 1/284 |
| 2020/0138104 | A1 | 5/2020 | Tucker et al. | |

FOREIGN PATENT DOCUMENTS

| | | | |
|---|---|---|---|
| JP | 2019-509110 | | 4/2019 |
| JP | 2019-524121 | | 9/2019 |
| JP | 2019-527064 | | 9/2019 |
| RU | 2 656 823 | C2 | 6/2018 |
| RU | 2 674 537 | C2 | 12/2018 |
| RU | 2 678 892 | C2 | 2/2019 |
| RU | 2 685 285 | C2 | 4/2019 |
| WO | WO 2013/045582 | A2 | 4/2013 |
| WO | WO 2015/117702 | A1 | 8/2015 |
| WO | WO 2015/117704 | A1 | 8/2015 |
| WO | WO 2016/005533 | A1 | 1/2016 |
| WO | WO 2018/153732 | A1 | 8/2018 |
| WO | WO 2019/134883 | A2 | 7/2019 |
| WO | WO 2020/115302 | A1 | 6/2020 |
| WO | WO 2020/115306 | A1 | 6/2020 |
| WO | WO 2020/115321 | A1 | 6/2020 |
| WO | WO 2020/115322 | A1 | 6/2020 |

OTHER PUBLICATIONS

Written Opinion issued Apr. 1, 2021 in PCT/EP2020/086817, filed on Dec. 17, 2020, 8 pages.

Partial European Search Report issued on Jun. 19, 2020 in European Patent Application No. 19218113.9, 11 pages.

Extended European Search Report issued on Aug. 12, 2020 in European Patent Application No. 19218113.9, 11 pages.

International Preliminary Report on Patentability issued on Mar. 23, 2022 in PCT/EP2020/086817 filed on Dec. 17, 2020, 15 pages.

Office Action issued Oct. 22, 2024, in Japanese Patent Application No. 2022-535540 with English Translation.

Russian Office Action mailed on Mar. 28, 2024, issued in Russian Patent Application No. 2022119356, with English Translation, total 7 pages.

Russian Search Report completed on Mar. 28, 2024, issued in Russian Patent Application No. 2022119356, with Translation of Categories, total 3 pages, therein.

* cited by examiner

CARTRIDGE FOR AN AEROSOL-GENERATING SYSTEM, AN AEROSOL-GENERATING SYSTEM INCLUDING A CARTRIDGE, AND A METHOD OF MANUFACTURING A HEATER ASSEMBLY AND CARTRIDGE FOR AN AEROSOL-GENERATING SYSTEM

The invention relates to aerosol-generating systems and in particular aerosol-generating systems that produce an aerosol for inhalation by a user.

One type of aerosol-generating system is an electrically heated smoking system. An electrically heated smoking system generates an aerosol for a user to inhale. Electrically heated smoking systems come in various forms. One popular type of electrically smoking system is an e-cigarette, which vaporises a liquid substrate to form an aerosol. One recent design uses a mesh heating element through which a vaporised substrate passes. An example is described in WO2015/117702.

Typically, these aerosol generating systems comprise a main unit comprising a power supply, which is reusable, and a cartridge containing a liquid substrate and a heater. The cartridge is typically a single use consumable unit, which is disposed of after the liquid substrate has been exhausted.

However, the consumable units are often complex and expensive to manufacture. In one widely used design, the heater is a coil of wire wound around a capillary material. This is not straightforward to manufacture. The cartridges are also difficult to recycle.

It would be desirable to produce a cartridge that is simple to manufacture and assemble. It would be desirable to produce a cartridge that is simple to recycle. It would be desirable to produce a cartridge that is which is compact and robust in use.

The invention is defined in the independent claims. Advantageous features are set out in the dependent claims.

In accordance with this disclosure a cartridge for an aerosol-generating device may comprise:

a housing containing an aerosol-forming substrate; and a heater element comprising fluid permeable heater portion and electrical contact portion. The heater portion and the electrical contact portion may be integrally formed from a single heater sheet. The heater portion may be enclosed within the housing and positioned to heat the aerosol-forming substrate and the electrical contact portion may extend outside the housing.

Using a single element to provide both a heater portion for heating the aerosol-forming substrate and a contact portion that can be connected to an external power supply, simplifies manufacture, and in particular minimises the number of separate components that need to be assembled. The heater portion is held within the housing and so is protected by the housing. The heater portion will typically be delicate. It requires a relatively high electrical resistance compared to the contact portion, and therefore a finer structure that is more easily damaged. The heater portion may comprise thin filaments, for example. Holding the heater portion within the housing provides a robust cartridge. The user is also protected from the heater portion by the housing in use. The electrical contact portion extends outside the housing to allow for the provision of electrical energy to the heater portion from an external power supply.

The heater portion may be planar and may lie in a first plane. A planar heater portion is simple to manufacture and simple to assemble in a cartridge. As used herein, planar means extending parallel to a Euclidean plane. The planar heater portion typically extends in two dimensions along a surface substantially more than in a third dimension. In particular, the dimensions of the planar heating element in the two dimensions within the surface may be at least five times larger than in the third dimension, normal to the surface.

The aerosol-forming substrate may be in a condensed form at room temperature. The aerosol-forming substrate may be a liquid at room temperature. The aerosol-forming substrate may be a solid at room temperature, or may be in another condensed form, such as a gel, at room temperature.

As used herein and below, the term "aerosol-forming substrate" refers to a substrate capable of releasing volatile compounds that can form an aerosol. The volatile compounds may be released by heating or combusting the aerosol-forming substrate.

As used herein and below, the term "aerosol" refers to a dispersion of solid particles or liquid droplets or a combination of solid particles and liquid droplets in a gas. The aerosol may be visible or invisible. The aerosol may include vapours of substances that are ordinarily liquid or solid at room temperature as well as solid particles or liquid droplets or a combination of solid particles and liquid droplets.

Heating of the aerosol-forming substrate by the heating element may release volatile compounds from the aerosol-forming substrate as a vapour. The vapour may then cool within the housing to form an aerosol.

The heating element may be configured to operate by resistive heating. In other words, the heating element may be configured to generate heat when an electrical current is passed though the heating element.

The electrical contact portion may be bent out of the first plane. This forms an out-of-plane section. This allows for simple shaping of electrical contacts into a configuration that is robust and provides a convenient and reliable electrical contact. The electrical contact portion may be bent so that the part of the electrical portion that extends outside the housing is parallel with an external surface of the housing. The electrical contact portion may be bent so that the part of the electrical portion that extends outside the housing is fitted to an external surface of the housing.

The heater element may be formed from a material that has some resilience. In particular, the electrical contact portion may be resilient. This may allow the electrical contact portion to be biased into contact with an external power supply, thereby ensuring a reliable electrical connection. Advantageously, the heater element is also malleable, allowing it to be bent into a desired configuration.

In operation, the heater portion may be heated as a result of electrical current passing through the heater portion. The heater element may comprise a first electrical contact portion and a second electrical contact portion positioned on opposite sides of the heater portion so that an electrical current flowing from the first electrical contact portion to the second electrical contact portion passes through the heater portion.

The heater portion may comprises one or more apertures or slots through the heater sheet. This may provide an increased electrical resistance compared to the electrical contact portion or portions. The one or more apertures or slots may comprise a spiral, a zig-zag pattern, or a grid pattern.

The heater sheet may be a foil. As used herein, a foil means a metal sheet. The heater sheet may comprise a metal sheet. The heater sheet may comprise stainless steel, copper, aluminium, silver or gold, for example. The heater sheet may comprise an electrically insulating sheet with relatively electrically conductive inclusions. The heater sheet may comprise a textile. The heater sheet may comprise a ceramic material. The heater sheet may comprise carbon fibre.

The heater portion may comprise a mesh, array or pattern formed from a plurality of electrically conductive filaments. The electrically conductive filaments may define interstices between the filaments and the interstices may have a width of between 10 μm and 100 μm. Preferably the filaments give rise to capillary action in the interstices, so that in use, liquid aerosol-forming substrate to be vaporised is drawn into the interstices, increasing the contact area between the heater portion and the liquid.

The electrically conductive filaments may form a mesh of size between 160 and 600 Mesh US (+/−10%) (i.e. between 160 and 600 filaments per inch (+/−10%)). The width of the interstices is preferably between 150 μm and 25 μm. The percentage of open area of the mesh, which is the ratio of the area of the interstices to the total area of the mesh, may be between 1% and 80%. The electrically conductive filaments consist of an array of filaments arranged parallel to one another.

The electrically conductive filaments may have a width of between 10 μm and 100 μm, preferably between 10 μm and 50 μm, and more preferably between 20 μm and 40 μm.

The area of the mesh, array or pattern of electrically conductive filaments may be between 10 and 100 $mm^2$, e.g., between 10 and 30 $mm^2$, or, e.g., between 30 and 100 $mm^2$. The mesh, array or pattern of electrically conductive filaments may, for example, be rectangular and have dimensions of 10 mm by 5 mm.

The electrical resistance of the mesh, array or pattern of electrically conductive filaments of the heater portion is preferably between 0.3 and 4 Ohms. More preferably, the electrical resistance of the heater portion is between 0.3 and 2 Ohms, and more preferably between about 0.5 and 1 Ohms, or about 0.55 Ohms.

The heater sheet may have a thickness of between 0.01 millimetres and 0.5 millimetres, and more preferably between 0.02 millimetres and 0.3 millimetres.

During operation the heater portion may reach a temperature of between 140 and 240 degrees centigrade. These temperatures allow for the generation of a dense and stable aerosol without combustion of the aerosol-forming substrate.

The heater sheet may comprise a generally U-shaped, planar section that includes the heater portion and first and second out-of-plane sections comprising at least part of the electrical contact portion. The first out-of-plane section may be connected to a first end of the U-shaped section and the second out-of-plane section may be connected to a second end of the U-shaped section. The first and second out-of-plane sections may comprise electrical contact pads. The out-of-plane sections may be positioned outside the housing. The U-shaped section may lie substantially within the housing.

The electrical contact portion or portions may be coated or plated with an electrically conductive material, such as gold, silver, copper or zinc. This may provide an improved contact resistance with an external power supply. It may also provide greater strength to the electrical contact portion or portions.

The heater portion may be coated or plated with an electrically conductive material, such as gold, silver, copper or zinc. This may provide improved resistance to corrosion. It may also provide an improved thermal conductivity (for faster heating and faster cooling). It can also reduce the electrical resistance if necessary for a given pattern of heater filaments.

In some embodiments, the heater portion has a first side in contact with the aerosol-forming substrate in the housing and a second side in contact with an airflow passage extending through the cartridge. The heater portion is advantageously vapour permeable. With this arrangement, vapour generated from the aerosol-forming substrate as a result of heating of the heater portion can pass through the heater portion into the airflow passage.

The aerosol-forming substrate may be a liquid at room temperature. The cartridge may comprise a wicking material configured to deliver liquid aerosol-forming substrate to the heater portion of the heater element.

The wicking material may have a fibrous or spongy structure. The wicking material preferably comprises a bundle of capillaries. For example, the wicking material may comprise a plurality of fibres or threads or other fine bore tubes. The fibres or threads may be generally aligned to convey liquid to the heater. Alternatively, the wicking material may comprise sponge-like or foam-like material. The structure of the wicking material forms a plurality of small bores or tubes, through which the liquid can be transported by capillary action. The wicking material may comprise any suitable material or combination of materials. Examples of suitable materials are a sponge or foam material, ceramic- or graphite-based materials in the form of fibres or sintered powders, foamed metal or plastics material, a fibrous material, for example made of spun or extruded fibres, such as cellulose acetate, polyester, or bonded polyolefin, polyethylene, terylene or polypropylene fibres, nylon fibres or ceramic.

The housing may comprise only a single wicking material. The housing may contain two or more different wicking materials, wherein a first wicking material, in contact with the heater portion, has a higher thermal decomposition temperature and a second wicking material, in contact with the first wicking material but not in contact with the heating element has a lower thermal decomposition temperature. The first wicking material effectively acts as a spacer separating the heater portion from the second capillary material, so that the second wicking material is not exposed to temperatures above its thermal decomposition temperature. As used herein, "thermal decomposition temperature" means the temperature at which a material begins to decompose and lose mass by generation of gaseous by products. The second wicking material may advantageously occupy a greater volume than the first wicking material and may hold more aerosol-forming substrate that the first wicking material. The second wicking material may have superior wicking performance to the first wicking material. The second wicking material may be a less expensive or have a higher filling capability than the first wicking material. The second wicking material may be polypropylene.

The cartridge may be refillable with aerosol forming-substrate. A reservoir refilling port may be provided in the external sleeve. The reservoir filling port may be closed by a reservoir cap. The reservoir may have a capacity of around 1 mL.

In some embodiments, the housing comprises an upper housing portion and a lower housing portion. The heater element may be arranged between the upper housing portion and the lower housing portion. The heater element may advantageously be clamped between the upper housing portion and the lower housing portion and so fixed in position relative to other components of the cartridge.

Clamping of the heater element in position is a relatively simple operation during assembly of the cartridge. The upper and lower housing portions may contact one or more points or areas on the electrical contact portion of the heater element to hold the heater element in position. The heater portion, which will be raised to high temperature may be held out of contact with the upper and lower housing portions.

The cartridge may further comprise an outer housing in which the upper housing and lower housing are held. In some embodiments, the outer housing comprises a sleeve into which the upper housing portion and lower housing portion are received in a direction parallel to the plane of the heater portion. This allows for a simple assembly process.

At least one of the upper housing portion and the lower housing portion may be formed from a resilient material, such as silicone rubber. The resilient material may be compressed by the outer housing, and thereby exerts a clamping force on the heater element. The resilient material may also provide a liquid tight and air tight seal with the outer housing.

The lower housing portion may comprise a bore across which the heater portion is positioned. This allows the heater portion to be held out of contact with the lower housing portion. The bore may form all or part of the liquid reservoir. It also allows aerosol-forming substrate to be positioned in the bore and heated by the heater portion. The aerosol-forming substrate may be heated by the heater portion by conduction. The cartridge may comprise a wicking material in the bore of the lower housing portion. The wicking material may be configured to deliver a liquid aerosol-forming substrate to the heater portion.

The cartridge may comprise an airflow passage extending from a distal end of the cartridge past the heater portion to a proximal end of the cartridge. At least a portion of the airflow passage may be defined between the upper housing portion and the lower housing portion. This allows for simple manufacture of the housing components.

The airflow passage may be substantially straight between the proximal and distal ends of the cartridge. This may reduce the collection of residue within the airflow passage when compared to designs with complex airflow paths.

The airflow passage may comprises at least one constriction between heater portion and the proximal end of the cartridge. The at least one constriction may aid aerosol formation. One or more filters may be provided in the airflow passage. A filter in the airflow passage may prevent large liquid droplets from leaving the cartridge through the mouthpiece.

The electrical contact portions may protrude from a distal end of the cartridge. This allows the cartridge to be easily connected to an external power supply. A mouthpiece may be provided at a proximal end of the cartridge. The airflow passage may have an outlet in the mouthpiece. The mouthpiece may be configured to allow a user to draw air through the airflow passage from the distal end to the proximal end with a puffing action. A replaceable mouthpiece element may be placed over the mouthpiece of the outer housing. The replaceable mouthpiece may be made from a softer material than the outer housing.

In some embodiments, the cartridge has a substantially prismatic shape, such as a cuboid shape. The cartridge may have a length, a width and a thickness. The thickness may extend in a direction orthogonal to the first plane and be substantially smaller than the length or the width. This shape of cartridge has been found to be popular with end users. The length may extend in a direction parallel to a line between the proximal and distal ends of the cartridge. The length may be greater than the width of the cartridge. The thickness may be no more than half as great as the length or the width of the cartridge. A relatively thin cartridge allows the cartridges to be comfortably stored in a user's pocket.

The external sleeve may be formed from metal or robust plastics materials. The upper and lower housing portions may be formed from a heat resistant plastics material. Advantageously, at least one of the upper and lower housing portions is formed from a resilient material, such as silicone rubber.

A cartridge as described has very few components and is simple to assemble. This has several advantages. A first advantage is good reliability. Having relatively few components means relatively few interactions between components and so less chance of misalignments of interfacing issues. It also means relatively few causes of failure.

A second advantage is reduced cost. This results both from reduced material costs for a compact cartridge with few parts and reduced manufacturing costs associated with simple tooling and few process steps.

A third advantage is the potential for reduced environmental impact. A cartridge as described uses relatively little raw materials. The materials that are used can be largely recyclable or biodegradable. And the cartridge is simple to disassemble enabling easier recycling and disposal of separate components.

A fourth advantage is that the cartridge can be made small in one dimension, orthogonal to the plane of the heater portion. This allows the cartridge to be easily stored and carried.

There is also disclosed an aerosol generating system comprising cartridge as described above and a main unit, the main unit comprising power supply and electrical contacts electrically connected to the power supply. The electrical contacts of the main unit may be configured to engage the electrical contact portion or electrical contact portions of the cartridge.

The main unit may comprise control circuitry configured to control the supply of power from the power supply to the electrical contacts. The control circuitry may comprise a puff sensor configured to detect user puffs on the system, and in particular on a mouthpiece of the system. The puff sensor may comprise an airflow sensor. The control circuitry may include a user interface that allows a user to activate the heater. The user interface may comprise a button or switch.

The main unit may have a length, a width and a thickness. The thickness may be no more than half as great as the length or the width. The width and thickness of the main unit may match a width and thickness of the cartridge.

The system may be configured so that power is provided to the heater portion from the power supply only during user puffs. Alternatively, the system may be configured so that power is provided to the heater portion both during and between user puffs. In some embodiments, more power may be provided to the heater portion during user puffs than between user puffs. During operation the heater portion may reach a temperature of between 140 and 240 degrees centigrade.

The main unit may be configured to supply power to the heater element according to a particular heating strategy. The control circuitry may include a puff sensor configured to detect user puffs on the system. The control circuitry may be configured to control the supply of power to the heater element dependent on an output from the puff sensor. The control circuitry may be configured to supply power to the heater element following detection of a user puff. The control circuitry may be configured to supply power to the heater element for a predetermined time period following detection of each user puff.

The main unit, and in particular the control circuitry, may be configured to supply a first, non-zero, power to the heater element, or to supply a power sufficient to maintain the heater portion at a first temperature or within a first temperature range, between user puffs. The main unit, and in particular the control circuitry, may be configured to supply a second power to the heater element during user puffs, wherein the second power is greater than the first power.

The provision of power to the heater element between user puffs can advantageously increase the volume of aerosol produced by the system. In combination with a heater portion having a relatively large surface area, this allows for high volumes of aerosol to be produced in a compact device, and at moderate temperatures for the heater element.

The control circuitry may comprise a microprocessor, which may be a programmable microprocessor, a microcontroller, or an application specific integrated chip (ASIC) or other electronic circuitry capable of providing control. The control circuitry may comprise further electronic components. The control circuitry may be configured to regulate a supply of power to the heater element. Power may be supplied to the heating element continuously following activation of the system. The power may be supplied to the heater element in the form of pulses of electrical current.

The system may be an electrically heated smoking system. The system may be a nicotine delivery system. The reservoir portion may contain an aerosol-forming substrate comprising nicotine.

The system may be a handheld aerosol-generating system. The aerosol-generating system may have a size comparable to a conventional cigar or cigarette. The smoking system may have a total length between approximately 30 mm and approximately 150 mm. The smoking system may have a width between approximately 10 mm and 50 mm. The smoking system may have a thickness between approximately 3 mm and approximately 10 mm.

The power supply may be a battery such as a lithium iron phosphate battery. As an alternative, the power supply may be another form of charge storage device such as a capacitor. The power supply may require recharging and may have a capacity that allows for the storage of enough energy for one or more smoking experiences. For example, the power supply may have sufficient capacity to allow for the continuous generation of aerosol for a period of around six minutes, corresponding to the typical time taken to smoke a conventional cigarette, or for a period that is a multiple of six minutes. In another example, the power supply may have sufficient capacity to allow for a predetermined number of puffs or discrete activations of the heater element.

Although the system has been described as a two piece system, consisting of a main unit and a cartridge, it is possible to provide a one piece system, in which the cartridge comprises a power source, such as battery, and control circuitry. In such a system, a separate main unit may not be required.

There is further disclosed a heater element for an aerosol-generating system, the heater element being formed from a single heater sheet and comprising a fluid permeable heater portion and electrical contact portion connected to the fluid permeable heater portion; wherein the fluid permeable heater portion is planar and lies in a first plane, and wherein the electrical contact portion is bent out of the first plane.

The heater element may comprise a first electrical contact portion and a second electrical contact portion positioned on opposite sides of the heater portion so that an electrical current flowing from the first electrical contact portion to the second electrical contact portion passes through the heater portion.

The heater portion may comprise one or more apertures or slots through the heater sheet. This may provide a region of increased electrical resistance. The apertures or slots may comprise a spiral, a zig-zag pattern or a grid pattern.

The heater sheet may be a foil. The heater sheet may comprise a metal sheet. The heater sheet may comprise stainless steel, copper, silver, aluminium or gold. The heater sheet may comprise an electrically insulating sheet with relatively electrically conductive inclusions. The heater sheet may comprise a textile. The heater sheet may comprise a ceramic material. The heater sheet may comprise carbon fibre.

The heater sheet may have a thickness of between 0.01 millimetres and 0.5 millimetres, and more preferably between 0.02 millimetres and 0.3 millimetres.

The heater sheet may comprise a generally U-shaped, planar section that includes the heater portion and first and second out-of-plane sections comprising at least part of the electrical contact portion. The first out-of-plane section may be connected to a first end of the U-shaped section and the second out-of-plane section may be connected to a second end of the U-shaped section. The first and second out-of-plane sections may comprise electrical contact pads.

The electrical contact portion or portions may be coated or plated with an electrically conductive material, such as gold. This may provide an improved contact resistance with an external power supply. It may also provide greater strength to the electrical contact portion or portions.

The heater portion may be coated or plated with an electrically conductive material, such as gold, silver, copper or zinc. This may provide improved resistance to corrosion. It may also provide an improved thermal conductivity (for faster heating and faster cooling). It can also reduce the electrical resistance if necessary for a given pattern of heater filaments.

A heater as described is simple to manufacture and easy to assemble into a finished cartridge or aerosol-generating device.

There is also disclosed a method of manufacturing a heater element for an aerosol-generating device comprising:

processing a planar sheet to form a heater element having a fluid permeable heater portion and at least one electrical contact portion connected to the heater portion lying in a first plane; and bending the electrical contact portion out of the first plane.

The planar sheet may be a foil. The planar sheet may comprise a metal sheet. The planar sheet may comprise stainless steel, copper, silver, aluminium or gold. The planar sheet may comprise an electrically insulating sheet with relatively electrically conductive inclusions. The planar sheet may comprise a textile. The planar sheet may comprise a ceramic material. The planar sheet may comprise carbon fibre. The planar sheet may comprise a laminate. The laminate may comprise layers formed from different materials.

The step of processing may comprise chemical etching, stamping or machining. The step of processing may comprise printing electrically conductive tracks on the planar sheet. The step of printing may comprise laser printing.

Manufacturing a heater element in this way can be achieved inexpensively and reliably in a mass manufacturing process. The resulting heater elements can be easily handled in an assembly process of a cartridge or aerosol generating device.

There is further disclosed a method of manufacturing cartridge for an aerosol-generating device, the method comprising:

forming a heater element having a fluid permeable heater portion and at least one electrical contact portion connected to the heater portion; and arranging the heater element between an upper housing portion and a lower housing portion such that heater portion lies between the upper housing portion and the lower housing portion, and the electrical contact portion extends outside of the lower housing portion and the upper housing portion.

This is a simple assembly process for a cartridge, involving relatively few components. It allows for rapid, reliable and inexpensive manufacturing.

The step of forming may comprise stamping, machining or etching a planar sheet to form the heater portion of the heater element. The step of forming may comprise printing electrically conductive tracks on a planar sheet.

The heater element may be first formed so that the heater portion and at least one electrical contact portion lie in a first plane. The method may further comprise bending the electrical contact portion out of the first plane.

The method may further comprise inserting the upper housing portion and the lower housing portion and heater element into an outer housing. The outer housing may be a sleeve. The upper housing portion and lower housing portion may be mechanically secured to the outer housing sleeve. For example, the outer housing sleeve and upper and lower housing portions may be shaped to provide a snap fitting. The outer housing may compress the upper housing portion or the lower housing portion, or both the upper and lower housing portions, to secure the upper and lower housing portions to the outer housing. The outer housing may compress the upper housing portion or the lower housing portion, or both the upper and lower housing portions, to provide a liquid tight seal.

The method may comprise filling a reservoir within the outer housing sleeve with a liquid aerosol-forming substrate.

The step of arranging may comprise clamping the heater element between the upper housing portion and the lower housing. In this way, it may not be necessary to provide any further means of securing the heater element within the cartridge, providing a simple assembly process. The outer housing sleeve may provide a clamping force on the heater element.

Also disclosed is a cartridge for an aerosol-generating device comprising:

a housing comprising an upper housing portion and a lower housing portion, the housing containing an aerosol-forming substrate; and a heater element comprising fluid permeable heater portion and electrical contact portion;

wherein the heater element is retained between the upper housing portion and the lower housing portion, wherein the heater portion is positioned to heat the aerosol-forming substrate, and wherein the electrical contact portion extends outside the housing.

The housing may comprise an outer housing, the upper housing portion and lower housing portion being held within the outer housing.

At least one of the upper housing portion and lower housing portion may be formed from a resilient material, such as silicone rubber. The resilient material may be compressed by the outer housing. This may provide a clamping force on the heater element to retain it. It may also provide a liquid tight seal between the outer housing and the upper and lower housing portions.

A liquid aerosol forming substrate may be held within the outer housing. The outer housing may be a sleeve. The upper housing portion or the lower housing portion, or both the upper housing portion and the lower housing portion, optionally together with the outer housing, may define a liquid reservoir in which the liquid is held. The lower housing portion may comprise a bore across which the heater portion is positioned. A wicking material may be provided in the bore of the lower housing portion. The wicking material may transport liquid from the reservoir to the heater portion. This has the benefit of delivering a consistent amount of liquid to the heater portion.

The cartridge may comprise an airflow passage extending from a distal end of the cartridge past the heater portion to a proximal end of the cartridge. Aerosol or vapour may be drawn out of the cartridge through the airflow passage. At least a portion of the airflow passage is defined between the upper housing and the lower housing. This allows the upper and lower housing portions to be formed with relative simple shapes that do not require complicate moulding processes and tools.

The airflow passage may be substantially straight between the proximal and the distal end of the cartridge. The airflow passage may comprise at least one constriction between the heater portion and the proximal end of the cartridge.

One or more filters may be provided in the airflow passage. A filter in the airflow passage may prevent large liquid droplets from leaving the cartridge through the mouthpiece.

The electrical contact portions may protrude from a distal end of the cartridge.

A mouthpiece may be provided at a proximal end of the cartridge. A replaceable mouthpiece element may be placed over the mouthpiece of the outer housing. The replaceable mouthpiece may be made from a softer material than the outer housing.

The cartridge may have a substantially prismatic shape. The cartridge may have a cuboid shape. The cartridge may have a length, a width and a thickness, wherein the thickness extends in a direction orthogonal to the first plane and is substantially smaller than the length or the width. The thickness may be no more than half as great as the length or the width of the cartridge. As previously described, this shape of cartridge has proven to be popular with consumers.

In all of the embodiments described, the aerosol-forming substrate is a substrate capable of releasing volatile compounds that can form an aerosol. The volatile compounds may be released by heating the aerosol-forming substrate.

The aerosol-forming substrate may comprise plant-based material. The aerosol-forming substrate may comprise nicotine. The aerosol-forming substrate may comprise tobacco. The aerosol-forming substrate may comprise a tobacco-containing material containing volatile tobacco flavour compounds, which are released from the aerosol-forming substrate upon heating. The aerosol-forming substrate may alternatively comprise a non-tobacco-containing material. The aerosol-forming substrate may comprise homogenised plant-based material. The aerosol-forming substrate may comprise homogenised tobacco material. The aerosol-forming substrate may comprise at least one aerosol-former. An aerosol-former is any suitable known compound or mixture of compounds that, in use, facilitates formation of a dense and stable aerosol and that is substantially resistant to thermal degradation at the operating temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol and, most preferred, glycerine. The aerosol-forming substrate may comprise other additives and ingredients, such as flavourants and water.

A cartridge as described has very few components and is simple to assemble. This has several advantages. A first advantage is good reliability. Having relatively few components means relatively few interactions between components and so less chance of misalignments of interfacing issues. It also means relatively few causes of failure.

A second advantage is reduced cost. This results both from reduced material costs for a compact cartridge with few parts and reduced manufacturing costs associated with simple tooling and few process steps.

A third advantage is the potential for reduced environmental impact. A cartridge as described uses relatively little raw materials. The materials that are used can be largely recyclable or biodegradable. And the cartridge is simple to disassemble, enabling easy recycling and disposal of separate components.

A fourth advantage is that the cartridge can be made small in one dimension, orthogonal to the plane of the heater portion. This allows the cartridge to be easily stored and carried.

It should be clear that features or elements described in relation to one example or embodiment may be applied to other described examples or embodiments. For example, the same wicking materials and the same aerosol-forming substrates may be used in each embodiment. Similarly, the same main unit may be used with different cartridges described.

Clauses Setting Out Preferred Features

1. A cartridge for an aerosol-generating device comprising:

a housing containing an aerosol-forming substrate;

a heater element comprising fluid permeable heater portion and electrical contact portion, wherein the heater portion and the electrical contact portion are integrally formed from a single heater sheet; and wherein the heater portion is enclosed within the housing and positioned to heat the aerosol-forming substrate and the electrical contact portion extends outside the housing.

2. A cartridge according to clause 1, wherein the heater portion is planar and lies in a first plane.

3. A cartridge according to clause 2, wherein the electrical contact portion is bent out of the first plane.

4. A cartridge according to any one of the preceding clauses, wherein the heater element comprises a first electrical contact portion and a second electrical contact portion positioned on opposite sides of the heater portion so that an electrical current flowing from the first electrical contact portion to the second electrical contact portion passes through the heater portion.

5. A cartridge according to any one of the preceding clauses, wherein the heater portion comprises one or more apertures or slots through the heater sheet.

6. A cartridge according to clause 5, wherein the one or more apertures or slots comprise a spiral, a zig-zag pattern or a grid pattern.

7. A cartridge according to any one of the preceding clauses, wherein the sheet has a thickness of between 0.01 millimetres and 0.5 millimetres, and more preferably between 0.02 millimetres and 0.3 millimetres.

8. A cartridge according to any one of the preceding clauses, wherein the electrical contact portion or portions are coated or plated with an electrically conductive material, such as gold.

9. A cartridge according to any one of the preceding clauses wherein the heater portion has a first side in contact with the aerosol-forming substrate in the housing and a second side in contact with an airflow passage extending through the cartridge.

10. A cartridge according to any one of the preceding clauses, wherein the aerosol-forming substrate is a liquid at room temperature.

11. A cartridge according to clause 10, comprising a wicking material configured to deliver liquid aerosol-forming substrate to the heater portion of the heater element.

12. A cartridge according to any one of the preceding clauses, wherein the housing comprises an upper housing portion and a lower housing portion, wherein the heater sheet is arranged between the upper housing portion and the lower housing portion.

13. A cartridge according to clause 12, further comprising an outer housing in which the upper housing and lower housing are held.

14. A cartridge according to clause 13, wherein the outer housing comprises a sleeve into which the upper housing portion and lower housing portion are received in a direction parallel to the plane of the heater portion.

15. A cartridge according to clause 12, 13 or 14, wherein at least one of the upper housing portion and the lower housing portion is formed from a resilient material, such as silicone rubber.

16. A cartridge according to any one of clauses 12 to 15, wherein the lower housing portion comprises a bore across which the heater portion is positioned.

17. A cartridge according to clause 16, comprising a wicking material in the bore of the lower housing portion.

18. A cartridge according to any preceding clause comprising an airflow passage extending from a distal end of the cartridge past the heater portion to a proximal end of the cartridge.

19. A cartridge according to any one of clauses 12 to 17, comprising an airflow passage extending from a distal end of the cartridge past the heater portion to a proximal end of the cartridge, and wherein at least a portion of the airflow passage is defined between the upper housing portion and the lower housing portion.

20. A cartridge according to clause 18 or 19, wherein the airflow passage is substantially straight between the proximal and distal ends of the cartridge.

21. A cartridge according to clause 18, 19 or 20, wherein the airflow passage comprises at least one constriction between heater portion and the proximal end of the cartridge.

22. A cartridge according to any one of the preceding clauses, wherein the electrical contact portions protrude from a distal end of the cartridge.

23. A cartridge according to any one of the preceding clauses, wherein a mouthpiece is provided at a proximal end of the cartridge.

24. A cartridge according to any one of the preceding clauses, wherein the cartridge has a substantially cuboid shape.

25. A cartridge according to any one of the preceding clauses, wherein the cartridge has a length, a width and a thickness, wherein the thickness extends in a direction orthogonal to the first plane and is substantially smaller than the length or the width.

26. A cartridge according to clause 25, wherein the thickness is no more than half as great as the length or the width of the cartridge.

27. A cartridge according to clause 25 or 26, wherein the length of the cartridge extends between the proximal end and the distal end of the cartridge and is greater than the width of the cartridge.

28. An aerosol generating system comprising cartridge in accordance with any one of the preceding clauses and a main unit, the main unit comprising power supply and electrical contacts electrically connected to the power supply and configured to engage the electrical contact portion or electrical contact portions of the cartridge.

29. An aerosol generating system according to clause 28, wherein the main unit comprises control circuitry configured to control the supply of power from the power supply to the electrical contacts.

30. An aerosol generating system according to clause 28 or 29, wherein the main unit has a length, a width and a thickness, and wherein the thickness is no more than half as great as the length or the width.

31. A heater element for an aerosol-generating system, the heater element being formed from a single heater sheet and comprising a fluid permeable heater portion and electrical contact portion connected to the fluid permeable heater portion; wherein the fluid permeable heater portion is planar and lies in a first plane, and wherein the electrical contact portion is bent out of the first plane.

32. A heater element according to clause 31, wherein the heater element comprises a first electrical contact portion and a second electrical contact portion positioned on opposite sides of the heater portion so that an electrical current flowing from the first electrical contact portion to the second electrical contact portion passes through the heater portion.

33. A heater element according to clause 31 or 32, wherein the heater portion comprises one or more apertures or slots through the heater sheet.

34. A heater element according to clause 33, wherein the apertures or slots comprise a spiral, a zig-zag pattern or a grid pattern.

35. A heater element according to any one of clauses 31 to 34, wherein the sheet has a thickness of between 0.01 millimetres and 0.5 millimetres, and more preferably between 0.02 millimetres and 0.3 millimetres.

36. A heater element according to any one of clauses 31 to 35, wherein the electrical contact portion or portions are coated or plated with an electrically conductive material, such as gold.

37. A method of manufacturing a heater element for an aerosol-generating device comprising:

processing a planar sheet to form a heater element having a fluid permeable heater portion and at least one electrical contact portion connected to the heater portion lying in a first plane; and bending the electrical contact portion out of the first plane.

38. A method according to clause 37, wherein the step of forming comprises stamping, machining or etching a planar sheet to form the heater portion of the heater element 39. A method of manufacturing cartridge for an aerosol-generating device, the method comprising:

forming a heater element having a fluid permeable heater portion and at least one electrical contact portion connected to the heater portion; and arranging the heater element between an upper housing portion and a lower housing portion such that heater portion lies between the upper housing portion and the lower housing portion, and the electrical contact portion extends outside of the lower housing portion and the upper housing portion.

40. A method according to clause 39, wherein the step of forming comprises stamping, machining or etching a planar sheet to form the heater portion of the heater element.

41. A method according to clause 39 or 40, wherein the heater element is first formed so that the heater portion and at least one electrical contact portion lie in a first plane, and the method further comprises bending the electrical contact portion out of the first plane.

42. A method according to any one of clauses 39 to 41, further comprising inserting the upper housing portion and the lower housing portion and heater element into an outer housing.

43. A method according to any one of clauses 39 to 42, comprising filling a reservoir within the outer housing with an aerosol-forming substrate.

44. A cartridge for an aerosol-generating device comprising:

a housing comprising an upper housing portion and a lower housing portion, the housing containing an aerosol-forming substrate;

a heater element comprising fluid permeable heater portion and electrical contact portion; and wherein the heater element is clamped between the upper housing portion and the lower housing portion, wherein the heater portion is positioned to heat the aerosol-forming substrate, and wherein the electrical contact portion extends outside the housing.

45. A cartridge according to clause 44, wherein the housing comprises an outer housing, the upper housing portion and lower housing portion being held within the outer housing.

46. A cartridge according to clause 44 or 45, wherein the at least one of the upper housing portion and lower housing portion is formed from a resilient material, such as silicone rubber.

47. A cartridge according to clause 44, 45 or 46, wherein the lower housing portion comprises a bore across which the heater portion is positioned.

48. A cartridge according to clause 47, comprising a wicking material in the bore of the lower housing portion.

49. A cartridge according to any preceding clause comprising an airflow passage extending from a distal end of the cartridge past the heater portion to a proximal end of the cartridge.

50. A cartridge according to clause 49, wherein at least a portion of the airflow passage is defined between the upper housing and the lower housing.

51. A cartridge according to clause 49 or 50, wherein the airflow passage is substantially straight between the proximal and the distal end of the cartridge.

52. A cartridge according to clause 49, 50 or 51, wherein the airflow passage comprises at least one constriction between the heater portion and the proximal end of the cartridge.

53. A cartridge according to any one of clauses 44 to 52, wherein the electrical contact portions protrude from a distal end of the cartridge.

54. A cartridge according to any one of clauses 44 to 53, wherein a mouthpiece is provided at a proximal end of the cartridge.

55. A cartridge according to any one of clauses 44 to 54, wherein the cartridge has a substantially cuboid shape.

56. A cartridge according to any one of clauses 44 to 55, wherein the cartridge has a length, a width and a thickness, wherein the thickness extends in a direction orthogonal to the first plane and is substantially smaller than the length or the width.

57. A cartridge according to clause 56, wherein the thickness is no more than half as great as the length or the width of the cartridge.

Embodiments of the invention will now be described, by way of example only, with reference to the accompanying drawings, in which.

Figure 1A:
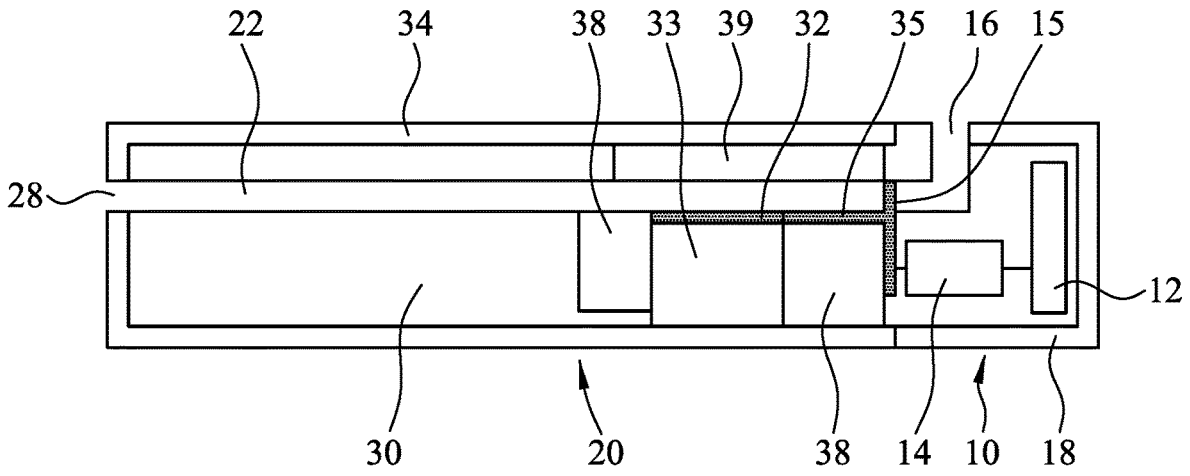
FIG. 1A is a schematic side view of an aerosol-generating system comprising a disposable cartridge.
Figure 1B:
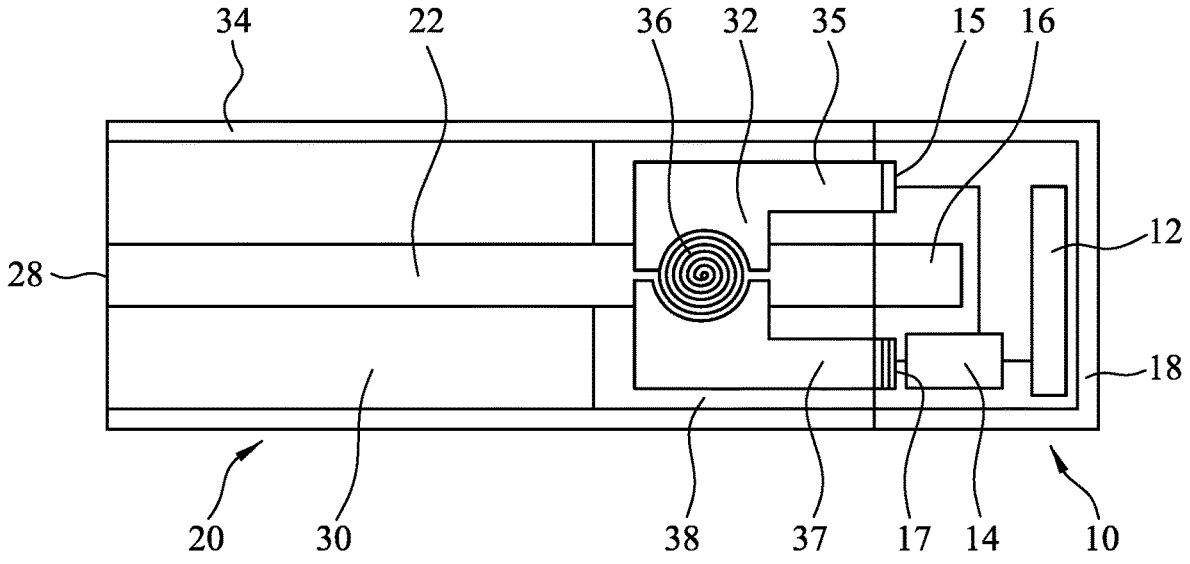
FIG. 1B is a schematic top view of the aerosol-generating system of FIG. 1A.

FIGS. 1A and 1B schematically illustrate an aerosol-generating system. The aerosol-generating system is a hand-held smoking system configured to generate aerosol for user inhalation. In particular, the system shown in FIGS. 1A and 1B is a smoking system that generates an aerosol containing nicotine and flavour compounds. FIG. 1A is a schematic side view. FIG. 1B is a schematic top view.

The system of FIGS. 1A and 1B comprises two parts, a main unit 10 and a cartridge 20. In use the cartridge 20 is attached to the main unit 10.

The main unit 10 comprises a device housing 18 that holds a rechargeable battery 12 and electrical control circuitry 14. The rechargeable battery 12 is a lithium iron phosphate battery. The control circuitry 14 comprises a programmable microprocessor and an airflow sensor.

The cartridge 20 comprises an outer housing 34, also referred to as an external sleeve, that is attached to the main unit 18. In this embodiment the cartridge is held on the main unit by a magnetic connection.

Within the external sleeve of the cartridge is an upper housing portion 39 and a lower housing portion 38. The upper and lower housing portions, together with the external sleeve, define a reservoir 30 for aerosol-forming substrate and an airflow passage 22 through the cartridge. A heater element 32 is held between the upper and lower housing portions. A fluid permeable heater portion 36 of the heater element 32 is positioned between the reservoir and the airflow passage 22. This is described in more detail with reference to FIGS. 2A and 2B.

The heater element 32 is a resistive heating element. The heater element 32 is formed from a single sheet, in this embodiment a stainless steel foil. As best seen in FIG. 1B, the heater element 32 comprises a heater portion 36 positioned between two contact portions 35 and 37. The heater portion 36 has a plurality of slots etched through it, leaving a spiral pattern of heater filaments connecting the two contact portions 35, 37. The filaments of the heater portion have a significantly higher electrical resistance than the contact portions and so the heater portion is heated significantly when an electrical current is passed through it.

The contact portions 35, 37 extend from either side of the heater portion to a position external to the cartridge. In particular, a section of each of the contact portions 35, 37 that is exterior to the cartridge housing portions is bent to provide an electrical contact pad for connection to corresponding electrical contacts 15, 17 in the main unit. The electrical contacts 15, 17 in the main unit are connected to the battery 12 through the control circuitry 14. Power is provided to the heater element 32 from the battery 12, under the control of the control circuitry, as will be described.

The cartridge holds an aerosol-forming substrate within the reservoir 30. In this example, the aerosol-forming substrate is a liquid mixture at room temperature and comprises nicotine, flavours, an aerosol-former, such a glycerol or propylene glycol, and water. The reservoir is defined between the lower housing portion and the external sleeve. A bore is formed in the lower housing portion that forms part of the reservoir. The heater portion of the heater element extends across the bore and separates the bore from the airflow passage 22. A capillary material 33 is provided in the bore of lower housing portion and is arranged to promote delivery of the aerosol-forming substrate to the heating element, regardless of the orientation of the system relative to gravity.

In this example, a portion of the airflow passage is through the cartridge 20 and a portion of the airflow passage is through the main unit 10. The airflow sensor included in the control circuitry is positioned to detect airflow through the portion of the airflow passage in the main unit. The airflow passage extends from an air inlet 16 to an air outlet 28. The air outlet 28 is in a mouthpiece end of the cartridge. When the user puffs on the mouthpiece end of the cartridge, air is drawn from the air inlet 16, through the airflow passage 22, to the air outlet 28.

The airflow passage 22 is, at least partially, defined between the upper and lower housing portions. The lower housing portion 38 is formed from a silicone rubber as is compressed between the external sleeve and the upper housing, which are made from more rigid materials. In this embodiment the upper housing portion is formed from Tritan™. Advantageously, all of the housing elements can be made of biodegradable or bio compostable plastics. The compression of the lower housing portion provides a liquid tight seal of the reservoir. It also provides an air tight seal of the airflow passage.

The heater portion 36 of the heater element 32 is positioned in the airflow channel 22. The heater portion is generally planar, with one side in fluidic communication, e.g., direct or indirect contact, with the liquid in the reservoir 30 and the opposite side in fluidic communication, e.g., direct or indirect contact, with the air passing through the airflow channel. In operation, liquid aerosol-forming substrate heated by the heater element is vaporised to form a vapour. The vapour can pass through the heater portion into the airflow channel.

In operation, the system may be activated by a user depressing a button (not shown) on the main unit. The control circuitry then supplies power to the heater element when an airflow through the airflow channel is detected by the flow sensor. In this embodiment, a consistent amount of power is supplied to the heater element each time a user puff is detected. This results in heating of the heater portion, which in turn generates a vapour in the airflow channel as, described. The vapour is entrained in the air flowing through the airflow channel and cools to form an aerosol before exiting the system through the air outlet 28.

Figure 2A:
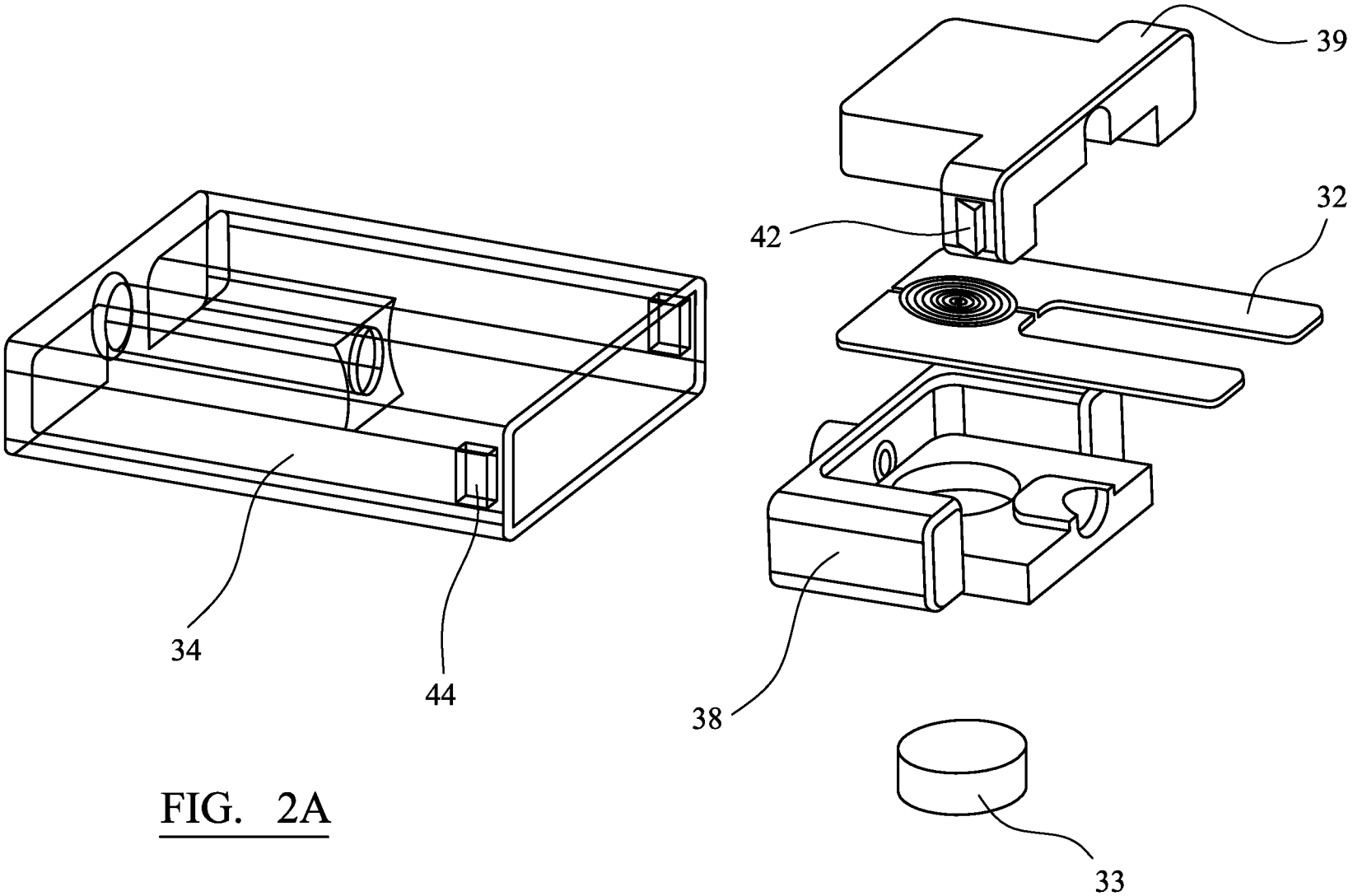
FIG. 2A is a view of the components of a disposable cartridge.
Figure 2B:
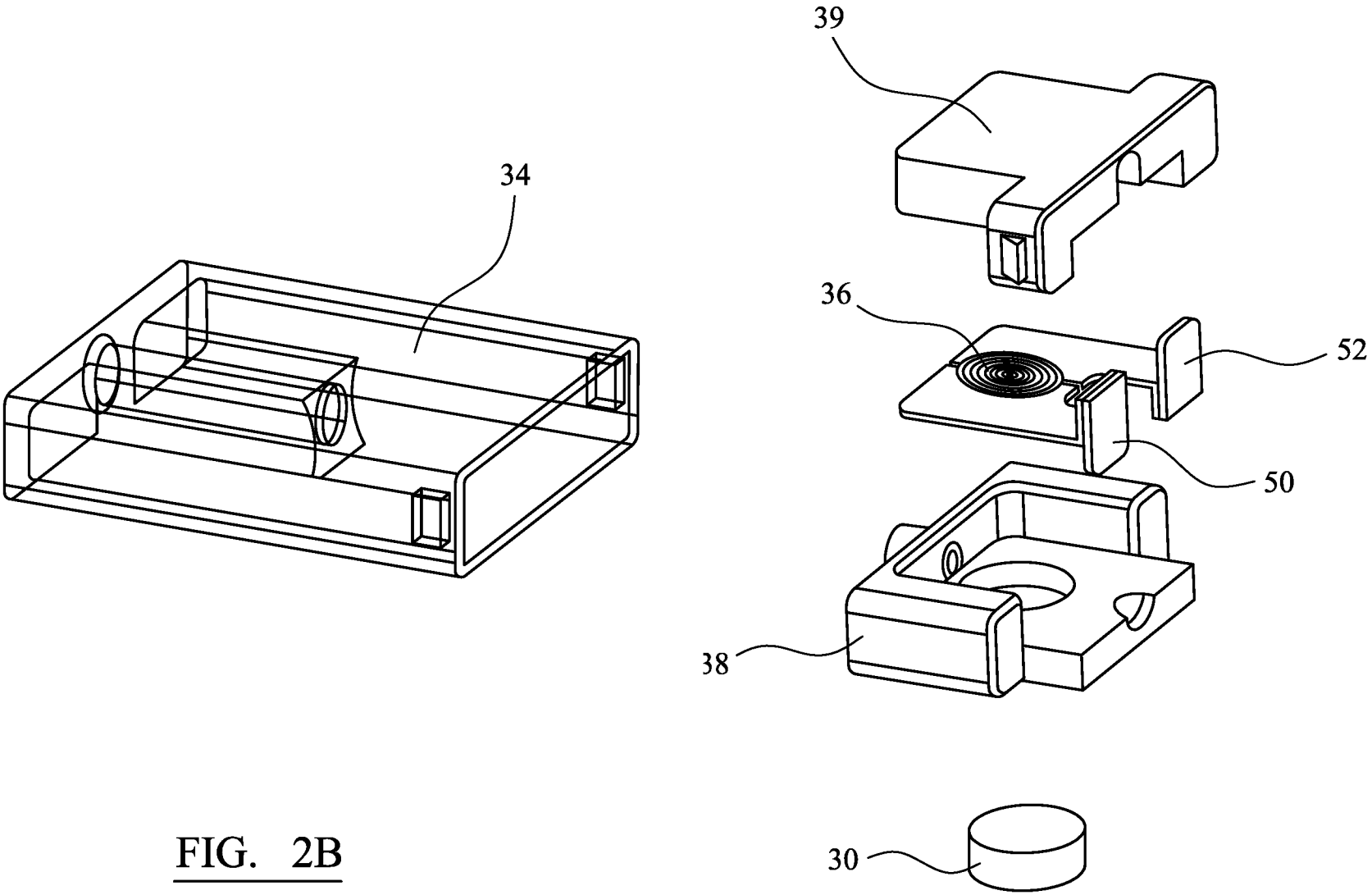
FIG. 2B shows the components of FIG. 2A with the heater bent into a finished configuration.

FIGS. 2A and 2B show an embodiment of cartridge consistent with the system illustrated in FIGS. 1A and 1B. FIG. 2A shows the components of the cartridge in exploded form, with the heater element in an unbent form. FIG. 2B shows the components of the cartridge in exploded form, with the contact portions of the heater element 32 bent to form electrical contact pads.

It can be seen from FIG. 2A that the heater element 32 is clamped between the upper housing portion 39 and the lower housing portion 38, with no further fixings required. The upper housing portion includes lugs 42 that snap into apertures 44 on the external sleeve 34 to secure the upper housing portion and lower housing portion to the external sleeve 34. The external sleeve is transparent, and an internal tube can be seen, forming a mouthpiece end of the airflow passage 22. The internal tube is an integrally moulded part of the external sleeve. The external sleeve, upper housing portion and lower housing portion are all moulded components. The wicking material 33 fits into the bore in the lower housing portion 38.

In FIG. 2A the heater element 32 is planar and unbent. The heater element has a U shape. FIG. 2B illustrates the heater element in its final form. The free ends of the U shape, corresponding to the sections of the electrical contact portions furthest from the heater portion, are bent to form two electrical contact pads 50, 52. The two electrical contact pads are positioned on opposite sides of the airflow passage 22 to one another. The heater element is bent so that the electrical contact pads extend perpendicular to the plane of the remainder of the heater element. The electrical contact pads are fitted close to the exterior surface of the cartridge, formed by the upper and lower housing portions. In this embodiment, the electrical contact portions are each folded twice, once through 90 degrees and then through 180 degrees, so that the electrical contact pads extend over substantially the entire thickness of the cartridge.

Figure 3:
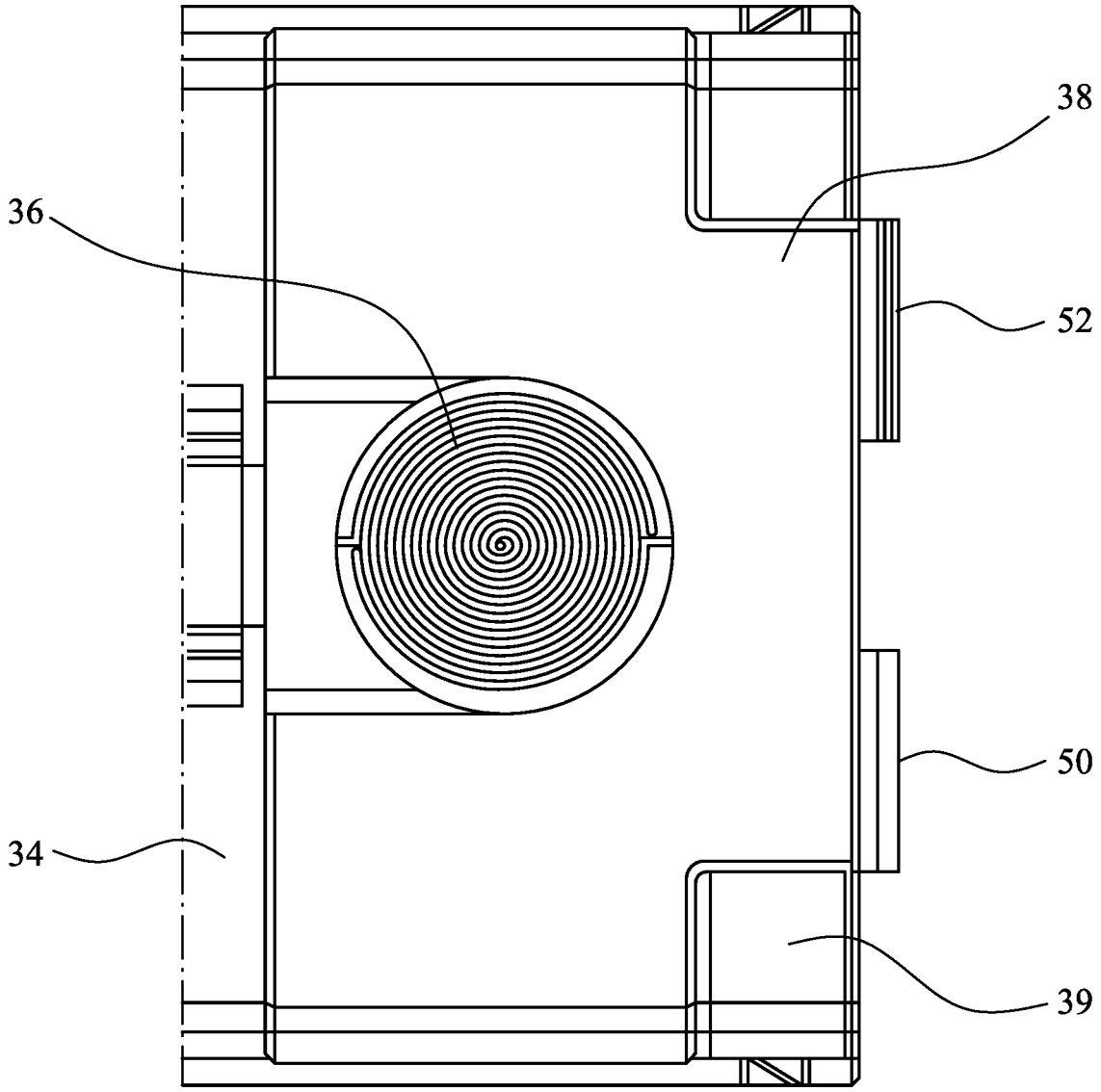
FIG. 3 shows an underside view of a portion the cartridge of FIG. 2A.

FIG. 3 shows in more detail the spiral design of the heater portion of the heater element. FIG. 3 is a bottom view of the cartridge of FIG. 2A, with the exterior sleeve 34 and wicking material show as transparent. The spiral heater filaments of the heater portion 36 can be clearly seen. Vaporised aerosol-forming substrate can pass between the filaments and into the airflow channel. In this example the thickness and width of the filaments is around 0.1 mm and the spacing between the filaments is around 0.1 mm. However, a foil thickness as low as 0.01 mm may be used for the heater portion. The electrical contact pads 50, 52 are shown extending just beyond the lower housing portion 38.

Figure 4:
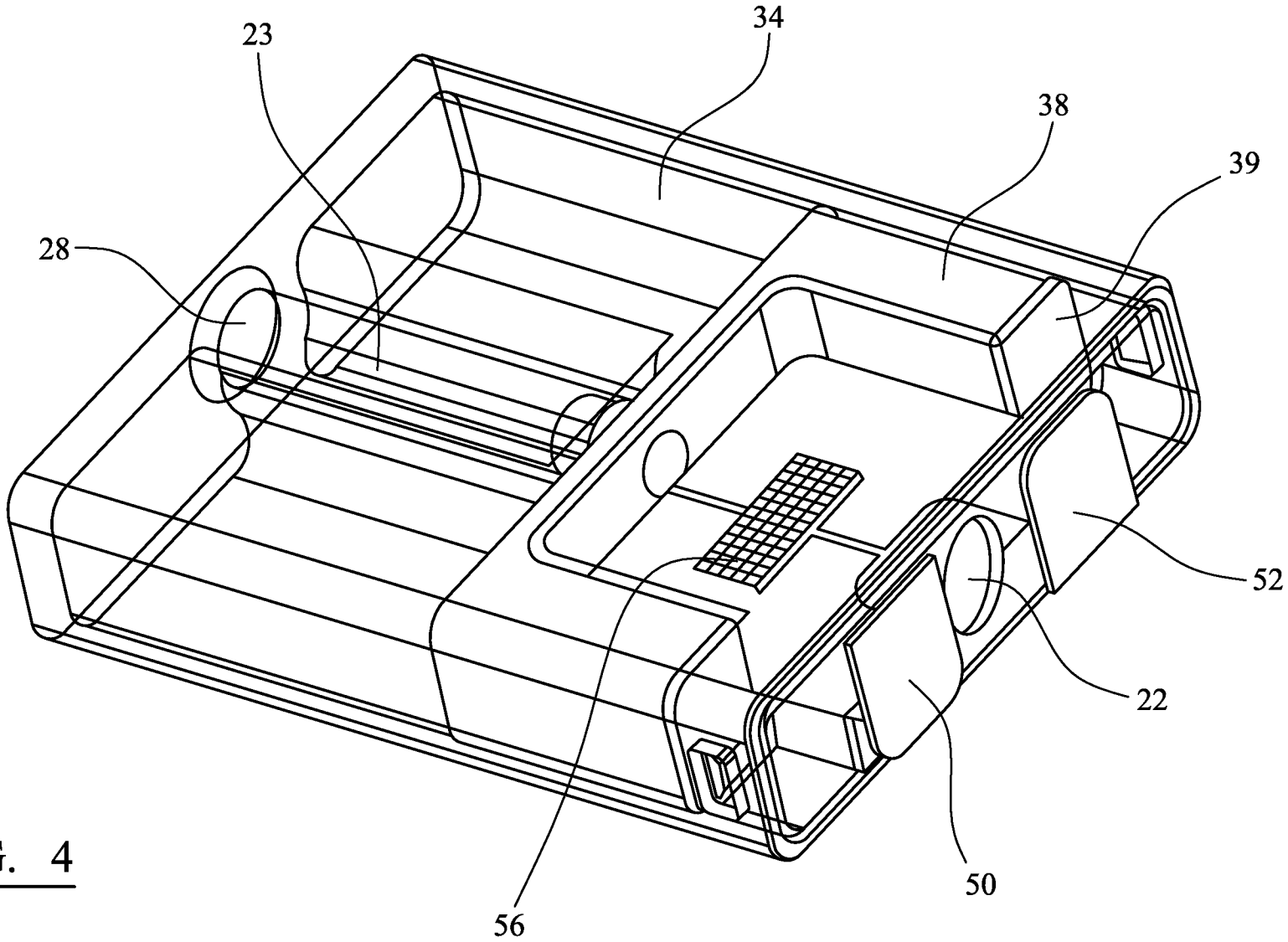
FIG. 4 is a perspective view of another disposable cartridge.

FIG. 4 is a perspective view of another embodiment of a cartridge. The embodiment of FIG. 4 is similar to the embodiment of FIGS. 2A, 2B and 3, but the heater portion is in the form of a grid or mesh instead of a spiral pattern.

In FIG. 4 the external sleeve 34 and the upper housing portion 39 are shown transparent so that the heater portion 56 can be seen. The heater portion 56 extends across the airflow channel 22 over the bore in the lower housing portion 38. The internal tube 23 in the external sleeve 34 that forms the mouthpiece end of the airflow channel can also be seen.

As in the embodiment of FIGS. 2A and 2B, the heater element is clamped between the upper and lower housing portions. The portions of the heater element exterior to the cartridge housing are bent to form the electrical contact pads 50, 52. The electrical contact pads in this embodiment are positioned on opposite sides of the airflow channel, as in the previous embodiment.

The cartridges described each comprise only five components: external sleeve, upper housing portion, lower housing portion, heater element and wicking material. The components can be made from recyclable or biodegradable materials and can be simply disassembled after use for recycling and disposal.

Figure 5:
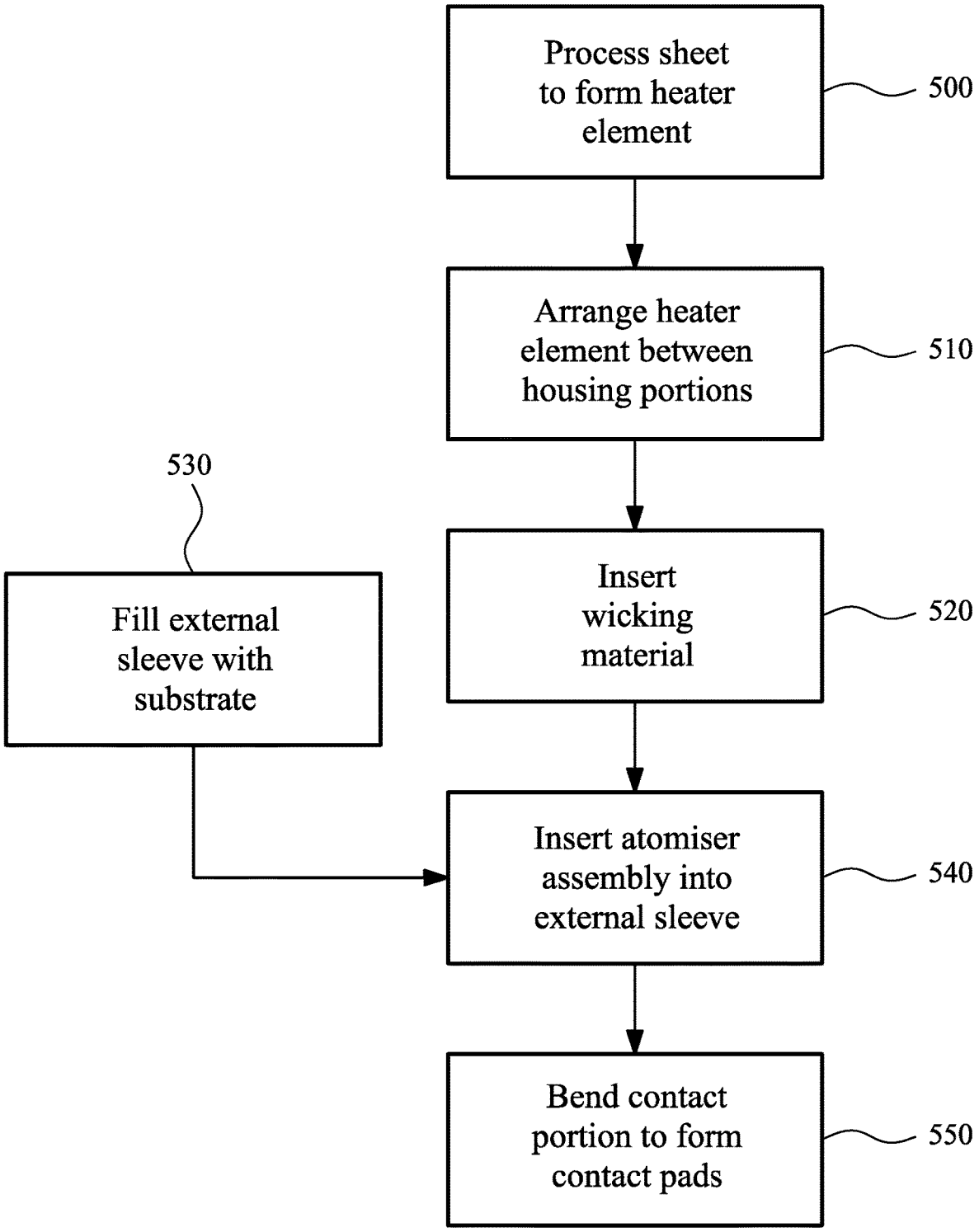
FIG. 5 is a flow chart illustrating an assembly process for a cartridge.

An example manufacturing and assembly process for a cartridge of the type shown in FIGS. 1 to 4 will now be described with reference to FIG. 5. FIG. 5 is a flow chart showing the steps of the manufacturing process.

In a first step 500, a planar sheet of material for the heater element is processed to form the heater portion and electrical contact portions. This processing step may comprise stamping, chemical etching, laser cutting or machining a foil or sheet material of suitable electrical conductance and mechanical properties. This processing step may comprise printing or otherwise depositing electrically conductive material onto a planar heater substrate. For example, a fluid permeable membrane may be used as a substrate and electrically conductive material forming the heater portion and the electrical contact portions may be deposited on the membrane.

Step 500 may also comprise coating the electrical contact portions, or at least those parts of the electrical contact portions than form the electrical contact pads, with an electrically conductive material, such as gold. This may reduce electrical contact resistance.

In step 510 the planar heater element is arranged between upper and lower housing portions. The upper and lower housing portions are moulded plastic components, as previously described. The heater element is positioned so the heater portion is aligned with the bore in the lower housing portion and with the airflow passage defined between the upper housing portion and the lower housing portion. The heater portion is enclosed within the upper and lower housing portions. Two contact portions of the heater element extend outside of the upper and lower housing portions.

In step 520 the wicking material is inserted into the bore of the lower housing portion. The heater element, upper housing portion, lower housing portion and wicking material for an atomiser sub-assembly.

In step 530, which may be carried out in parallel with steps 500 to 520, a reservoir portion of the external sleeve is filled with a liquid aerosol-forming substrate.

In step 540 the atomiser sub-assembly is inserted into the filled external sleeve. As described, a simple snap fitting or other mechanical interlock can be used to secure the atomiser sub-assembly to the external sleeve. The lower housing portion is compressed by the external sleeve to provide a liquid tight seal for the reservoir and an airtight seal for the airflow channel.

In step 550 the exposed contact portions of the heater element are bent to form electrical contact pads, extending parallel to a surface of the upper and lower housing portions. It should be clear that step 550 can be carried out at any stage after step 500. It does not need to be performed after step 540.

As an alternative to step 530, filling the exterior sleeve, or in addition to step 530, it is possible to soak the wicking material in liquid or gel aerosol-forming substrate prior to insertion of the wicking material into the bore of the lower housing portion.

The manufacturing and assembly process illustrated in FIG. 5 is simple to perform. It only requires assembly of five components and does not require any fixing elements, such as screws, or any adhesives. The heater element is very simply secured within the cartridge. The heater element being planar also makes it easy to handle.

The invention claimed is:

1. A cartridge for an aerosol-generating device, the cartridge comprising:

a housing containing an aerosol-forming substrate, the housing comprising an upper housing portion and a lower housing portion;

a heater element comprising a fluid-permeable heater portion and an electrical contact portion, wherein the fluid-permeable heater portion and the electrical contact portion are integrally formed from a single heater sheet, and wherein the fluid-permeable heater portion is enclosed within the housing and positioned to heat the aerosol-forming substrate, and the electrical contact portion extends outside the housing; and an outer housing in which the upper housing portion and the lower housing portion are held, the outer housing comprising a sleeve into which the upper housing portion and the lower housing portion are received such that the outer housing compresses the upper housing portion and the lower housing portion together to provide a seal therebetween.

2. The cartridge according to claim 1, wherein the fluid-permeable heater portion is planar and lies in a first plane.

3. The cartridge according to claim 2, wherein the electrical contact portion is bent out of the first plane.

4. The cartridge according to claim 1, wherein the heater element comprises a first electrical contact portion and a second electrical contact portion positioned on opposite sides of the fluid-permeable heater portion so that an electrical current flowing from the first electrical contact portion to the second electrical contact portion passes through the fluid-permeable heater portion.

5. The cartridge according to claim 1, wherein the fluid-permeable heater portion comprises one or more apertures or slots through the single heater sheet.

6. The cartridge according to claim 1, wherein the fluid-permeable heater portion has a first side in contact with the aerosol-forming substrate in the housing and a second side in contact with an airflow passage extending through the cartridge.

7. The cartridge according to claim 1, wherein the single heater sheet is clamped between the upper housing portion and the lower housing portion.

8. The cartridge according to claim 7, wherein the outer housing compresses the upper housing portion and the lower housing portion to clamp the heater element between the upper housing portion and the lower housing portion.

9. The cartridge according to claim 1, wherein the upper housing portion and lower housing portion are received in the sleeve in a direction parallel to a plane of the fluid-permeable heater portion.

10. The cartridge according to claim 1, wherein at least one of the upper housing portion and the lower housing portion is formed from a resilient material.

11. The cartridge according to claim 10, wherein the resilient material is silicone rubber.

12. An aerosol generating system, comprising:

a cartridge according to claim 1; and a main unit comprising a power supply and electrical contacts electrically connected to the power supply and being configured to engage the electrical contact portion or electrical contact portions of the cartridge.

13. A method of manufacturing a cartridge for an aerosol-generating device, the method comprising:

integrally forming a heater element having a fluid-permeable heater portion and at least one electrical contact portion from a single heater sheet;

arranging the heater element between an upper housing portion and a lower housing portion such that the fluid-permeable heater portion lies between the upper housing portion and the lower housing portion, and the electrical contact portion extends outside of the lower housing portion and the upper housing portion; and receiving the upper housing portion and the lower housing portion within a sleeve of an outer housing such that the outer housing compresses the upper housing portion and the lower housing portion together to provide a seal therebetween.

14. The method according to claim 13, further comprising:

processing a planar sheet to form the heater element such that the fluid-permeable heater portion and the at least one electrical contact portion lie in a first plane; and bending the electrical contact portion out of the first plane.

15. The method according to claim 14, wherein the step of processing the planar sheet comprises stamping, machining, or etching the planar sheet to form the fluid-permeable heater portion of the heater element.

16. A cartridge for an aerosol-generating device, the cartridge comprising:

a housing comprising an upper housing portion and a lower housing portion, the housing containing an aerosol-forming substrate;

a heater element comprising a fluid-permeable heater portion and an electrical contact portion integrally formed from a single heater sheet, wherein the heater element is retained between the upper housing portion and the lower housing portion, and wherein the fluid-permeable heater portion is positioned to heat the aerosol-forming substrate, and wherein the electrical contact portion extends outside the housing; and an outer housing in which the upper housing portion and the lower housing portion are held, the outer housing comprising a sleeve into which the upper housing portion and the lower housing portion are received such that the outer housing compresses the upper housing portion and the lower housing portion together to provide a seal therebetween.

* * * * *